US010422059B2

(12) United States Patent
Owen

(10) Patent No.: US 10,422,059 B2
(45) Date of Patent: Sep. 24, 2019

(54) BRAIDING MACHINE

(71) Applicant: JDR Cable Systems Ltd, Cambridgeshire (GB)

(72) Inventor: Gareth Adrian Owen, Cambridgeshire (GB)

(73) Assignee: JDR Cable Systems Ltd., Littleport, Ely, Cambridgeshire (GB)

( * ) Notice: Subject to any disclaimer, the term of this patent is extended or adjusted under 35 U.S.C. 154(b) by 586 days.

(21) Appl. No.: 14/671,807

(22) Filed: Mar. 27, 2015

(65) Prior Publication Data

US 2015/0275409 A1 Oct. 1, 2015

(30) Foreign Application Priority Data

Mar. 28, 2014 (GB) ..... 1405590.9

(51) Int. Cl.
*D04C 3/48* (2006.01)
*D04C 3/00* (2006.01)

(52) U.S. Cl.
CPC ..... *D04C 3/48* (2013.01); *D04C 3/00* (2013.01)

(58) Field of Classification Search
CPC ..... D04C 3/48
See application file for complete search history.

(56) References Cited

U.S. PATENT DOCUMENTS 3,345,812 A * 10/1967 Pickering ..... D07B 7/08 200/61.18
3,599,529 A 8/1971 Richardson
3,659,406 A * 5/1972 Kipperberg ..... D07B 3/06 324/515
3,759,026 A * 9/1973 Hope ..... D01H 13/1658 200/61.18
4,266,461 A 5/1981 Molitors
4,410,803 A * 10/1983 Henze ..... D01H 13/1658 112/273
4,608,496 A * 8/1986 Rosen ..... D07B 7/08 250/559.43
4,753,149 A * 6/1988 Celani ..... D04C 3/40 87/14
5,043,708 A * 8/1991 Kimura ..... D01H 13/1616 340/677
5,206,709 A * 4/1993 Schewe ..... B65H 63/0324 250/559.43
5,331,175 A * 7/1994 Morris ..... B65H 63/0324 250/559.43
5,520,084 A 5/1996 Chesterfield
2011/0283870 A1 11/2011 Head

FOREIGN PATENT DOCUMENTS

CN 2880870 Y 3/2007
CN 101654845 A 2/2010
JP H0754249 A 2/1995

* cited by examiner

*Primary Examiner* — Shaun R Hurley
(74) *Attorney, Agent, or Firm* — John Lynn

(57) ABSTRACT

The present invention provides a means for shutting down a braiding machine to prevent damage to a product to which the braided yarn is applied under failure conditions such as when a yarn breaks. Failure of the yarn or the tensioning of the yarn causes an imbalance in the tensioning on the product causing it to be displaced from its normal position and this displacement is detected to shut the braiding machine down.

17 Claims, 3 Drawing Sheets

BRAIDING MACHINE

FIELD OF THE INVENTION

The present invention relates to braiding machines and in particular to the control of braiding machines to prevent damage to the product being manufactured.

BACKGROUND TO THE INVENTION

Braiding machines may be used for a variety of different purposes such as producing ropes or forming a woven coverage around a substrate. For the latter, the coverage is formed by interweaving individual yarns and forming them into a structure around the substrate. The yarns and the substrate itself can take many different forms depending upon the application and the woven coverage that is formed can serve a number of different purposes from reinforcing the underlying substrate to providing a protective layer, providing a separating layer and so on.

A typical braiding machine 1 might be composed of sets of bobbins, typically two, which are arranged to travel along two separate paths. The bobbins have the yarn wound onto them initially so that it can be unwound from the bobbin as it travels along its path. The two paths 11, 12 are arranged (see the solid 11 and dotted 12 lines in FIG. 1) so that as each bobbin 23 travels along its path, it passes between the bobbins travelling on the other path in a generally opposite direction. In this way, half the bobbins travel generally clockwise around the machine whilst the other half travel generally counter-clockwise.

As each bobbin travels along the path it will sequentially pass another bobbin on the other path to the right and then to the left and so on. This in and out movement is transferred to the yarns which extend from the bobbins, as shown in FIG. 2. This in and out motion on the yarns, weaves the yarns into cylindrical sheath around the substrate or work product to be wrapped.

FIG. 2 shows a schematic arrangement of the elements in a braiding process for applying a braid to a substrate 21. The substrate is provided on a reel 20 which pays out the substrate 21 to be fed to a braiding machine 22. The braiding machine 22 includes a number of bobbins 23 mounted on a platform to allow the bobbins to travel along their designated paths. Although in this example, the braiding machine is mounted with a horizontal axis, these machines may be used with a vertical axis as well.

Each bobbin includes a length of yarn which in use is unwound from the bobbin and extends to meet the substrate 21 at the braiding point 25. A number of yarns 24 each extend from one of the bobbins 23 and are wound at the braiding point 25 to form a braided substrate 26. The substrate and the braided substrate are drawn through the braiding machine 22 by a drive or caterpillar 27 which controls the speed at which the substrate passes through the braiding machine. The finished braided substrate is then received onto a storage reel 28.

FIG. 1 shows an example of a braiding machine end on. The circles 23 represent the bobbins travelling along the two paths 11 and 12. The arrows show the direction of travel of the bobbins on each of the paths. In this example, eight bobbins travel along each of the two paths. The bobbins typically include a peg at their bases which travels within the track defining the paths 11, 12 and is driven by a gearing mechanism behind the track plate. The gears are arranged so as to drive the bobbins along their designated tracks and retain them in a suitably spaced arrangement so that the bobbins travel freely around their tracks without interfering with each other.

FIG. 3 shows a more details view of a typical braiding machine. Again, as with the example in FIG. 1, this machine has eight bobbins arranged in each of the two paths giving a total of sixteen bobbins, each feeding a yarn 24 to the braiding point 25. The substrate 21 is typically fed from one side of the machine through the centre of the braiding plate towards the braiding point 25 which lies along the central axis of the machine.

In order to ensure that the braid is uniformly formed and the braids are suitably tightly arranged, the yarns are fed from the bobbin under tension. The bobbin would typically include a tensioning arrangement to provide this tension. It is important that the tension on each of the bobbins is uniform and that the tension in all the bobbins is largely the same. In FIG. 4 it can be seen that the tension on each of the yarns are applied to the substrate at the braiding point 25. Thus the bobbins are generally uniformly arranged around the centre of the braiding point and because the bobbins maintain a consistent tension in each of the yarns, the forces provided by the yarns balances out so that there is no net force on the substrate at the braiding point 25. This ensures that the substrate and the braided product 26 maintain a central position between all the yarns to give a good quality braid product.

Typically each individual bobbin has a pay off station with a mechanical clutch which controls the let off tension of the yarn or wire. The tensions are set prior to starting manufacture. As indicated above, it is important that each bobbin pay off tension is maintained during a production run. If the tensions vary during a production run, this can have a negative effect on the product being manufactured, i.e. the product does not conform to specification which can lead to product not meeting the test criteria, therefore it will not be fit for purpose and will have to be remade.

Under normal operating conditions, with adequate tensions maintained on all the yarns, the braiding process will be completed without problems. However if there is a mechanical failure with one of the bobbins or the yarn payoff mechanism or if a yarn becomes entangled or snagged on some other part of the machine or if one of the yarns breaks or runs out then the normal tensioning arrangement of the machine will be disturbed.

Usually, the main clutch component is a spring assembly. These springs have a tendency to fail periodically without any signs prior to the failure. If a spring snaps during a production run this causes the yarn to pull tight against the substrate (product being manufactured) causing irreparable damage, where the product has to be remade.

FIG. 4 shows schematically what happens if one of the yarns is broken but the effect is similar if the yarn tension is too high or too low. The failure of a yarn will remove the small portion of the tension that is provided by that yarn. This will result in an imbalance in the load applied to the substrate at the braiding point 25. As shown in FIG. 4, the tension provided by the broken yarn will leave a net force on the substrate and will tend to pull it away from its normal position. This displacement of the substrate generally creates a disturbance in the equilibrium of the braiding process and may affect the tensioning of the other yarns which may further exacerbate the problem and cause the substrate to be further deviated from its normal position. This typically results in further failures and damage to the substrate itself.

Again if the clutch mechanism fails either reducing the tension in a yarn or increasing the tension a similar imbalance will occur. Other failure modes are possible such as snagging of the yarn on the clutch mechanism.

The braiding machines themselves typically operate at very high speeds so that if a yarn does break, the effect and the consequences of it can result in the substrate being damaged very quickly long before an operator can stop the machine to rectify the problem. Braiding machines generally do not have very good fail safe mechanisms in place to monitor the product being manufactured, but they normally do stop after a catastrophic failure.

This failure will normally result in the damaged substrate and the previously produced braided product having to be discarded and the entire production process restarted with a new substrate.

The present invention aims to overcome or at least ameliorate some of the problems of the existing braiding machines.

SUMMARY OF INVENTION

According to a first aspect of the invention there is provided a control system for a braiding machine arranged for applying a braided yarn sheath to a substrate, the control system comprising: a detector arranged to detect deviation of said substrate from a predetermined path; and a controller arranged to output a stop signal for stopping said braiding machine in response to said detected deviation.

The control system can provide a way of detecting a fault in the braiding process which might lead to irreparable damage to the work product and provides a signal which can be used to stop the braiding machine to prevent or limit such damage.

Preferably, the controller is arranged to output the stop signal when the deviation exceeds a first threshold. This threshold can be determined to allow normal operation of the machine where normal limited variations in the position of the substrate are acceptable.

The controller can monitor the deviation of the substrate detected by the detector for a period of time during normal operation to determine the first threshold. In this way, an indication of the normal tolerances of the movement of the substrate can be determined for the specific job being carried so that when an abnormal situation arises, the controller can shut the braiding machine down. Different materials such as yarn and substrate may have different properties and may require different set ups on the braiding in machine and this may lead to different tolerance for different jobs.

Preferably, the controller is arranged to output a warning signal when the deviation exceeds a second threshold. The controller may also be arranged to output a stop signal to the braiding machine when the deviation exceeds the second threshold for a predetermined period of time. This allows the machine to go outside of a first tolerance but still operate whilst still shutting down if the first threshold is exceeded.

The detector may include a die having an orifice through which the substrate is arranged to pass such that deviation of the substrate causes the substrate to engage the die. One or more load cells may be arrange so as to be engaged with the die to detect load applied to the die by the displacement of the substrate.

The present invention also provides a method for controlling a braiding machine arranged for applying a braided yarn sheath to a substrate, the method comprising: detecting deviation of said substrate from a predetermined path; and outputting a stop signal for stopping said braiding machine in response to said detected deviation.

The method may further comprise outputting the stop signal to the braiding machine when the deviation exceeds a first threshold.

The detected deviation of the substrate may be monitored for a period of time during normal operation to determine the first threshold. Furthermore, a warning signal may be output when the detected deviation exceeds a second threshold.

The method preferably includes outputting a stop signal to the braiding machine when the detected deviation exceeds the second threshold for a predetermined period of time.

The method may also include passing the substrate through an orifice in a die such that deviation of the substrate causes the substrate to engage the die, and wherein detecting of the deviation comprises detecting the engagement of the substrate with the die.

One or more load cells may be engaged with the die to detect load applied to the die by the displacement of the substrate and wherein the detecting of the deviation comprises measuring the respective loads in at least one of the load cells.

The present invention further provides a braiding machine comprising a control system such as that described above, or operated according the method described above.

BRIEF DESCRIPTION OF THE DRAWINGS

A preferred embodiment of the present invention will now be more particularly described by way of example only with reference to the accompanying drawings, wherein.

DESCRIPTION OF THE PREFERRED EMBODIMENTS

Figure 5A:
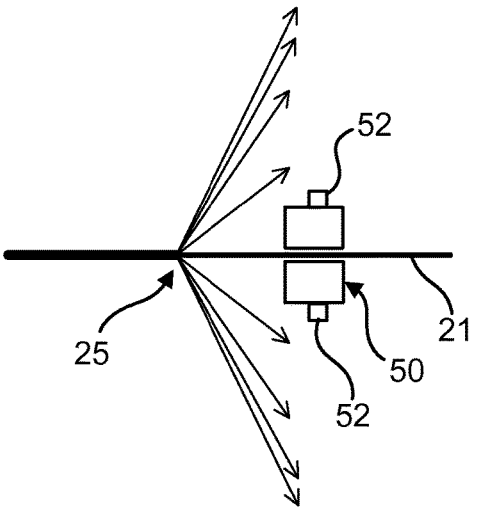
FIG. 5*a* shows the load cell of the present invention arranged around the substrate under normal conditions.

FIG. 5*a* shows the arrangement of the yarns and substrate near the braiding point 25, the yarns are formed into the braid around the substrate. In this embodiment of the invention, a detector 50 is provided. The detector 50 includes a die 51 which includes an orifice 60 through which the substrate 21 is fed towards the braiding point 25. The die is selected so that the orifice through it can receive the substrate 21 with a small amount of clearance such that as the substrate is fed through it, it can run substantially freely without the die interfering with the passage of the substrate through it.

The die is supported by a number of load cells 52, in this embodiment arranged circumferentially around the outside of the die. The load cells 52 are designed to detect the load applied to them by the die. The load cells are attached to the body of the machine and the die is supported between them.

Figure 5B:
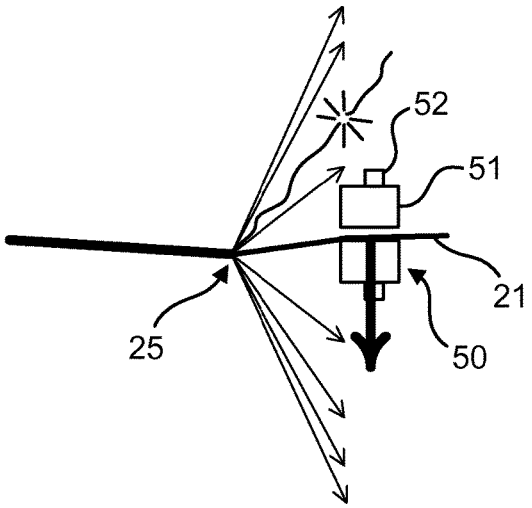
FIG. 5*b* shows the present invention under failure conditions.
Figure 6:
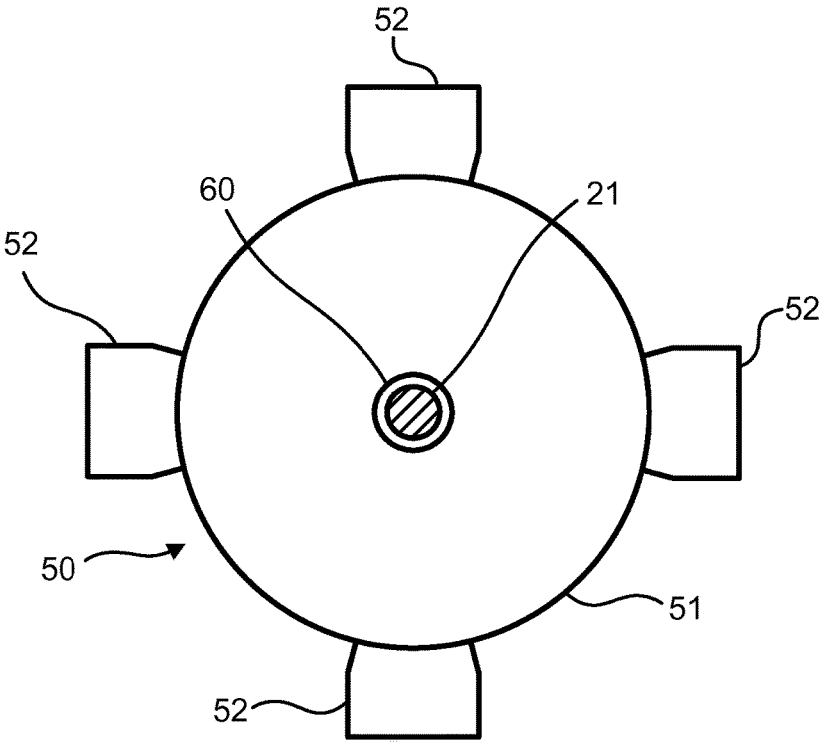
FIG. 6 shows a detailed view of the detector of the invention.

FIG. 6 shows an end view of the die 51 with the four load cells 52 arranged around it. Although it is not shown in FIGS. 5 and 6, the load cells are mounted on the body of the braiding machine or some other suitable mounting bracket. In this way, the die is suspended by the load cells. Any force applied to the die is therefore transferred to the load cells.

Under normal operating conditions, the substrate 21 would pass through the orifice in the die 51 and the load on the load cells 52 will remain substantially constant. Each load cell 52 is independent and records the load applied which is used to provide an indication of the deflection of the substrate.

Figure 1:
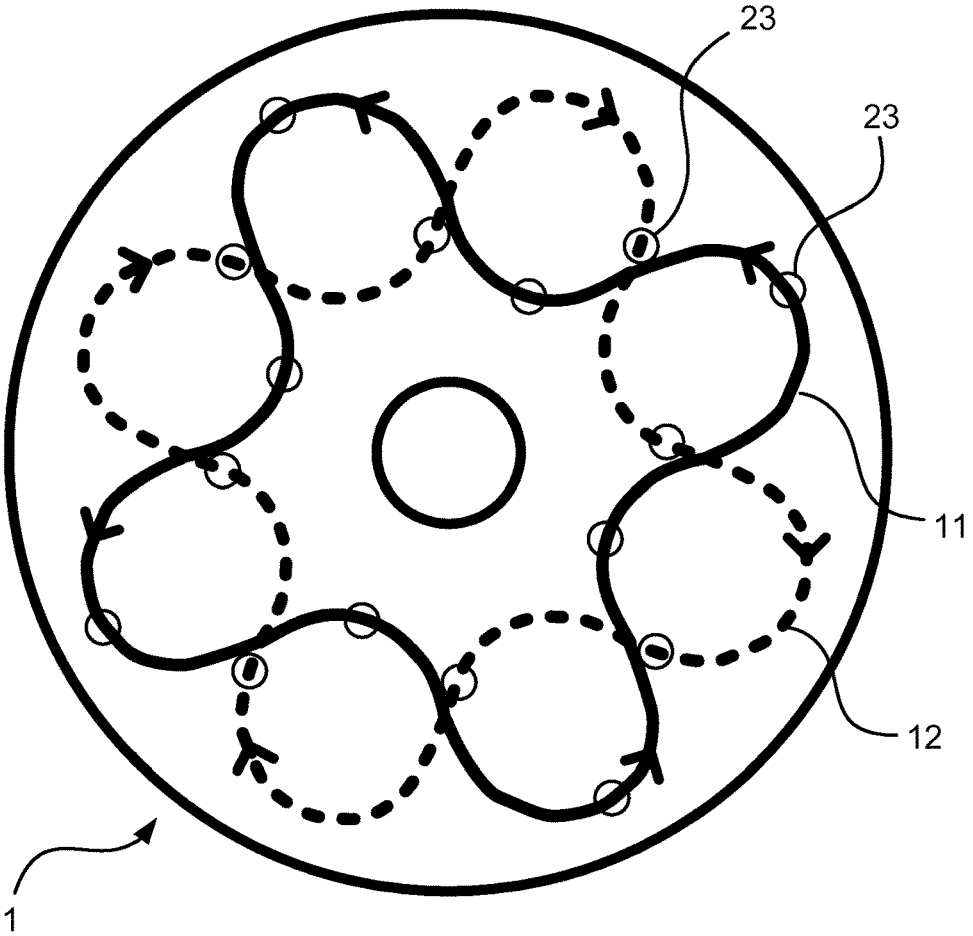
FIG. 1 shows schematically the pathways followed by bobbins on a braiding machine.
Figure 2:
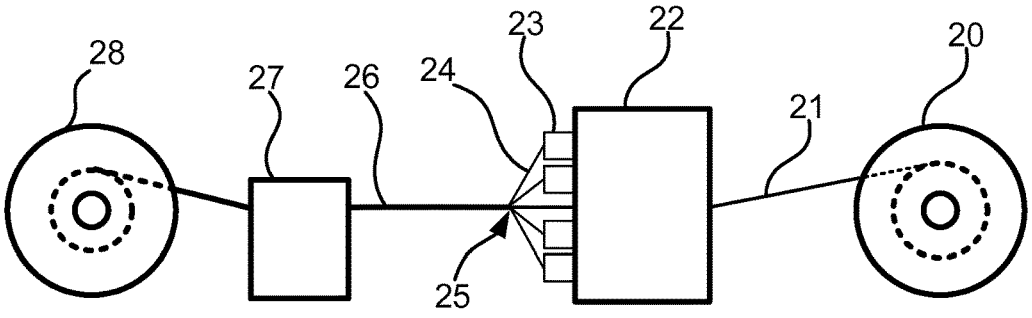
FIG. 2 shows the basic structure of a braiding process.
Figure 3:
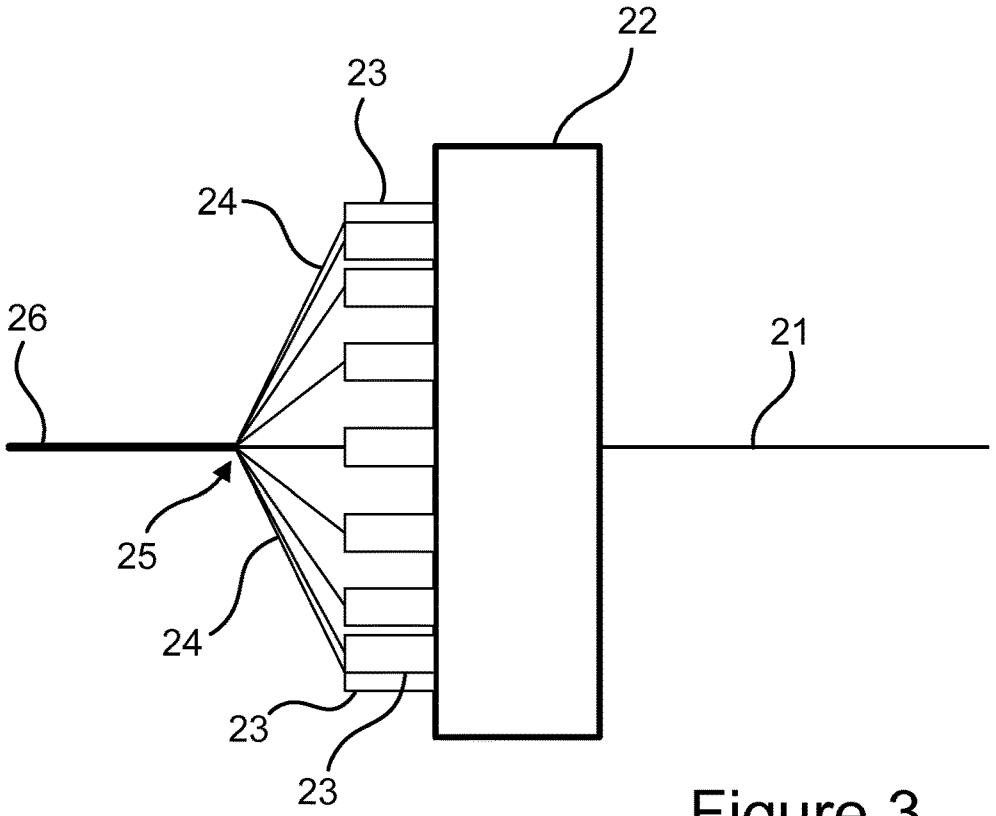
FIG. 3 shows a more detailed view of a braiding machine.
Figure 4A:
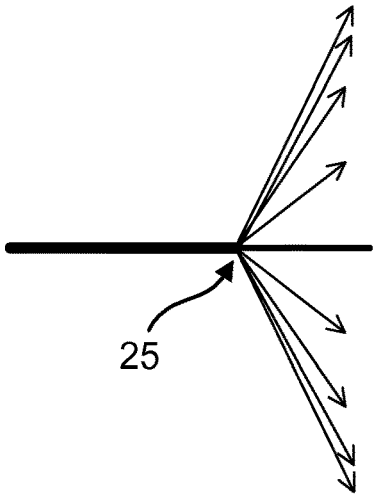
FIG. 4*a* shows the tensioning of the braiding around a braiding point.
Figure 4B:
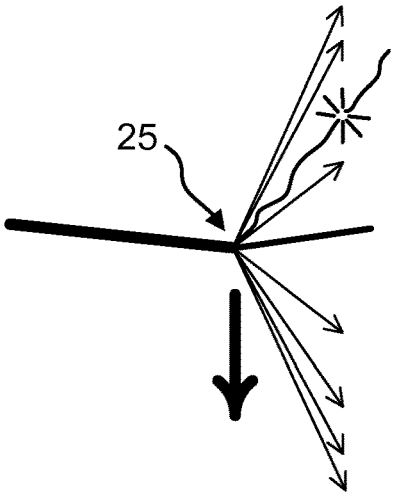
FIG. 4*b* shows the displacement effect of a broken yarn.

However, if one of the yarns breaks, as in the example of FIG. 4*b*, or some other failure event occurs such as the yarns becoming snagged or one of the clutch mechanisms providing the tension to the yarns failing, the tension on the yarns will become imbalanced. As indicated above, this will cause the substrate 21 to be displaced away from its normal axis of travel. As shown in FIG. 5*b*, substrate 21 is pushed against the side of the die applying a force to it. This force will in turn be transferred to the load cells, varying the load detected by the load cells. The load measured by the load cells is passed to a controller (not shown) which monitors the detected loads. As the detected loads move outside of an acceptable tolerance, eventually a failure mode is identified and remedial action can be taken to stop the braiding machine and prevent damage to the substrate or the braided product.

The controller may be designed to determine that a failure has occurred when the load variance exceeds a threshold. This would allow minor variations to be ignored as normal operational variations. The braiding process is a complex mechanical process with a large number of moving parts and with yarn and substrate material which will have some minor imperfections. This will lead to some limited movement of the substrate under normal operation. This movement may apply a small but measurable force to the die 51 which in turn will affect the forces measured by the load cells 52. By setting the threshold above appropriately, such normal variations can be ignored and only when the loads experience by the load cells exceed the threshold will action need to be taken.

At the start of a production run, the load in the load cells can be measured. This measured load will represent the variance due to a small amount of deflection difference between load cells. Once the maximum and minimum deflection has been identified, these can then be used to determine a tolerance to work to. This tolerance can then be used to define the threshold referred to above. This may be done manually by displaying the measured load or displacement on a display and allowing the operator to set the required threshold value, or it may be automated.

As the bobbins are rotating at high speed, a broken yarn will cause the direction of the imbalance in the tension to rotate and so the effective displacing force on the substrate will also appear to rotate. Furthermore the yarn could break at any point on the cycle and so initial displacement of the die could be in any direction. Using the four load cells 52 shown in FIG. 6, displacement in any direction will affect at least one of the four load cells 52. In this way, regardless of where the yarn breaks, the displacement of the substrate will be detected by at least one of the load cells, if not all.

It will be appreciated that a different number of more or less load cells could be used and still be able to detect the displacement of the die and hence the substrate.

Once the controller has detected sufficient displacement of the substrate to determine that a significant fault has occurred, the braiding machine can be shut down. The shutting down of the machine will occur substantially faster than relying on an operator to detect a fault visually or any existing mechanisms to detect a catastrophic failure. For example, some braiding machines are provided with a loop catcher that can detect slack loops in the product. If a yarn does become slack, the loose material is caught on a spike in a die. Once caught, this pulls the die displacing it from its normal position which breaks a circuit causing the machine to stop.

Such mechanisms only operate when a yarn becomes slack and typically do not respond quickly enough to prevent damage to the workpiece and so generally do not solve the problem of having to restart the entire job. Some machine have no method of detecting faults and simply rely on an operator to spot a problem and manually shut the machine down. Relying on the operator is again too slow to stop the machine before irreparable damage has occurred.

By shutting down the machine rapidly, the potential damage caused by running the machine with yarn tensions unbalanced may be avoided or at least the duration minimised. This should ensure that the machine is shut down before any significant damage to the substrate occurs. In this way, the yarn may be reattached or repaired and the braiding operation restarted and the product already produced saved from being wasted.

In the above-described situation, a yarn breaking will cause a significant imbalance in the tensioning at the braiding point 25. However, as indicated above, each bobbin includes its own tensioning system and these systems may also fail either completely or partially. For example, if one of the tensioning mechanisms on one of the bobbins fails such that it does not apply the correct tension to the yarn extending from it, then this may initially not adversely affect the braiding operation and have no damaging effect on the substrate or the finished product. However, a small imbalance caused by incorrect tensioning may still lead the substrate to deflect and engage the die 51.

If the tension is only slightly out of tolerance then the displacement may be relatively small compared to a complete failure of a yarn and the change in the load on the load cells 52 may not be as large. The value of the load at which shut down occurs may be selected at a first threshold level but between that level and a lower second threshold level of the measured load, the machine is not shut down but a warning state is set to indicate that at least one of the bobbin tensions is not at its optimum value. The operator may then determine whether or not to shut down the machine and rectify the problem.

In this way, minor imbalances of tension can be detected without causing a full shut down of the machine while still providing protection against a substantial catastrophic failure in the braiding operation. Such minor imbalances may be tolerated for a significant period of time so that the current run can be completed and the problem rectified when the machine is shut down, for example to replenish the bobbins etc.

By selecting suitable tolerance levels, the operator can set values for when the machine shuts down automatically under a fault condition or when it simply provides a warning. Again, the controller may have further intelligent controls such that above a certain tolerance the machine will always shut down but below that level and above a lower level, the machine continues to operate in an "out of tolerance" condition. The machine controller may determine that this "out of tolerance" condition may continue for a limited period of time before shutting the machine down.

Whilst the embodiment above utilises load cells to measure the movement of the substrate from the central position, other methods of detecting the displacement may be used. For example, the dye may be arranged so that it can be displaced against a resilient mounting such by mounting it on springs. This displacement may then be measured using known methods such as optically, mechanically, acoustically etc.

Furthermore, the die may be dispensed with completely and the position of the substrate monitored. For example, a beam of light may be shone across the path of the substrate and the amount of transmitted light either side of the substrate measured with variations in the amount of light indicating displacement form the neutral position. This may be duplicated at different angles to measure displacement in different directions. Yet further methods could also be used and it is not intend that the invention be limited to the embodiment described above.

The invention claimed is:

1. A control system for a braiding machine arranged for applying a braided yarn sheath to a substrate, the control system comprising:

a detector including a die having an orifice through which said substrate is arranged to pass and wherein deviation of said substrate from a predetermined path causes said substrate to engage and apply a load to said die, said load being detected by said detector; and a controller arranged to output a stop signal for stopping said braiding machine in response to said detected load.

2. A control system according to claim 1 wherein said controller is arranged to output said stop signal when said load exceeds a first threshold.

3. A control system according to claim 2 wherein said controller monitors said load for a period of time during normal operation to determine said first threshold.

4. A control system according to claim 2 wherein said controller is arranged to output a warning signal when said load exceeds a second threshold.

5. A control system according to claim 4 wherein said controller is arranged to output a stop signal to said braiding machine when said load exceeds said second threshold for a predetermined period of time.

6. A control system according to claim 3 wherein said controller is arranged to output a warning signal when said load exceeds a second threshold.

7. A control system according to claim 6 wherein said controller is arranged to output a stop signal to said braiding machine when said load exceeds said second threshold for a predetermined period of time.

8. A control system according to claim 1 wherein said detector further comprises one or more load cells engaged with said die to detect said load applied to said die by said deviation of said substrate.

9. A method for controlling a braiding machine arranged for applying a braided yarn sheath to a substrate, the method comprising:

passing said substrate through an orifice in a die such that deviation of said substrate from a predetermined path causes said substrate to engage and apply a load to said die;

detecting said load due to said deviation of said substrate from said predetermined path; and outputting a stop signal for stopping said braiding machine in response to said detected load.

10. A method according to claim 9, further comprising outputting said stop signal to said braiding machine when said load exceeds a first threshold.

11. A method according to claim 10, further comprising monitoring the detected load for a period of time during normal operation to determine said first threshold.

12. A method according to claim 10, further comprising outputting a warning signal when said detected load exceeds a second threshold.

13. A method according to claim 12, further comprising outputting a stop signal to said braiding machine when said detected load exceeds said second threshold for a predetermined period of time.

14. A method according to claim 11, further comprising outputting a warning signal when said detected load exceeds a second threshold.

15. A method according to claim 14, further comprising outputting a stop signal to said braiding machine when said detected load exceeds said second threshold for a predetermined period of time.

16. A method according to claim 9, wherein one or more load cells are engaged with said die to detect said load applied to said die by said deviation of said substrate and wherein said detecting of said load comprises measuring the respective loads in at least one of said load cells.

17. A braiding machine for applying a braided yarn sheath to a substrate having a control system, comprising:

a detector including a die having an orifice through which said substrate is arranged to pass and wherein deviation of said substrate from a predetermined path causes said substrate to engage and apply a load to said die, said load being detected by said detector; and a controller arranged to output a stop signal for stopping said braiding machine in response to said detected load.

* * * * *